US005094541A

United States Patent [19]

Nelson

[11] Patent Number: 5,094,541

[45] Date of Patent: Mar. 10, 1992

[54] MIXER APPARATUS AND METHOD OF BLENDING VARIOUS MATERIALS

[75] Inventor: Robert D. Nelson, Jacksonville, Fla.

[73] Assignee: JTM Industries, Inc., Kennesaw, Ga.

[21] Appl. No.: 590,881

[22] Filed: Oct. 1, 1990

[51] Int. Cl.[5] ..... B01F 15/02

[52] U.S. Cl. ..... 366/185; 366/189; 366/297; 366/298; 366/601

[58] Field of Search ..... 366/83, 85, 84, 64, 366/61, 297–301, 45, 46, 47, 41, 27, 42, 185, 189, 194, 195, 196, 606, 601

[56] References Cited

U.S. PATENT DOCUMENTS

| | | | |
|---|---|---|---|
| 1,845,367 | 2/1932 | Totman | 366/46 |
| 3,128,085 | 9/1960 | Madsen . | |
| 3,563,515 | 1/1971 | Chapman . | |
| 3,853,305 | 8/1974 | Mize . | |
| 4,268,174 | 5/1981 | Falardeau | 366/46 |
| 4,529,134 | 2/1985 | Williams . | |
| 5,005,980 | 4/1991 | Zimmerman | 366/297 |

*Primary Examiner*—Robert W. Jenkins
*Attorney, Agent, or Firm*—Biebel & French

[57] ABSTRACT

A mixing apparatus for mixing materials of various consistencies includes a pair of mixer shafts having radially extending blades thereon for mixing the material as the shafts rotate. Each shaft is driven by a hydraulic motor and the hydraulic motors are located in separate hydraulic fluid circuits. The relative rotational orientation of the shafts to each other is controlled by appropriate control of the separate hydraulic fluid circuits. In addition, a mixer body incorporating the mixer shafts is suspended from a frame of the apparatus by means of cables such that the mixer body may be lifted and lowered relative to the frame. The mixer body is provided with an aperture through which material may be loaded into the body and through which material may be emptied out of the body by actuating the cables to rotate the body to an inverted position.

25 Claims, 5 Drawing Sheets

MIXER APPARATUS AND METHOD OF BLENDING VARIOUS MATERIALS

BACKGROUND OF THE INVENTION

The present invention relates to a mixing apparatus and, more particularly, to a pug mixer for mixing relatively viscous batches of material such as industrial waste being mixed with stabilizing and neutralizing agents.

Waste materials such as those produced by industry, as well as those excavated from existing contaminated disposal areas, often require treatment prior to final disposition. Such treatment includes combining the contaminated material with the necessary cementitious ingredients and/or other chemical additives to create a homogeneous material which, when solidified and/or neutralized, will prevent the contaminants from migrating into the environment.

The requirements for treating the waste materials are widely varied depending upon the consistency and chemical nature of the materials. For example, the materials may be dry and uniformly graded, such as arc dust generated by steel producers in the operation of carbon arc furnaces, sticky clay, such as result from the use of earthen materials to retain waste chemicals or paint residues collected from the filter systems of coating operations, while others may be in the form of fluids as well as in the form of solid materials such as plastic and paperboard containers. Other loads discharged at the treatment facility will include a plastic slip sheet or truck body liner that has protected the body of the truck during shipment.

To accomplish the proper blending of contaminated material with neutralizing chemical agents, it is necessary to accurately proportion the materials and homogenize each constituent material for the time and speed required to complete the proper transformation to a composite non-toxic or less toxic material, acceptable for final disposal.

Since each different material requires a different method of treatment including varying mixing times and different proportions of waste material to the neutralizing/ stabilizing agents, it is impractical to provide a continuous flow mixing system to process these waste materials. It has been found that such a mixing operation is best performed using a batching procedure wherein a given quantity of the waste material is mixed in each batch and in which the residence time of the material in the mixer may be adequately controlled to effect the proper chemical change in the material.

While many prior art batch-type mixers have been proposed, such mixers typically include an opening in the top of the mixing box or bin through which material may be loaded into the mixer, and an aperture in a lower part of the mixer with a closure member wherein the closure member may be moved to allow the material to discharge out of the bottom of the mixer. Such a mixer is disclosed in U.S. Pat. No. 3,853,305 to Mize and may be subject to leakage of fluid materials past the sealing points between the closure member and the bottom aperture in the bin. In addition, any seals which are provided at the sealing point between the closure and the aperture may be subject to deterioration as a result of contact with corrosive materials such as are typically found in hazardous wastes.

U.S. Pat. No. 3,563,515 to Chapman discloses another mixing machine for mixing batches of material in which the material is both loaded and unloaded through an aperture in a top portion of the mixer. This mixer is provided with means for tilting the mixer from an upright position to empty the material therein and includes lightweight hydraulic motors to facilitate the tilting operation. The mixing bin of the unit must be mounted at a high enough elevation for it to empty into a container of a desired height and such an arrangement may not be practical where the materials are intended to be emptied into the bed of a large capacity receiving bin having high side walls.

Other problems with prior art of mixers include typical difficulties associated with mixing non-homogeneous material wherein the blades of the mixer jamb as they encounter large bulk pieces of foreign material. Such a jamming situation may result in breakage of the blades or breakage of any gears in the transmission mechanism of the blade drive shafts.

In addition, prior art mixers have not provided means for adjusting the relative rotational position of one set of blades to the other such that a desired shear effect may be obtained depending upon the viscosity of the material being mixed. Nor have prior art mixers provided means whereby an acceptable stabilized material may be produced en masse from a formula developed in the laboratory for each specific waste stream. Such an apparatus would require means for weighing a specific amount of first material which requires homogenizing in the mixer for a given period of time prior to adding a specific weight amount of a second material, and further providing means whereby the first and second materials may be blended over a given or extended period of time to effect the proper chemical change prior to adding additional materials.

Accordingly, there is a need for a mixer which may be easily loaded with material and unloaded without the need for a movable closure element which may be subject to failure and leakage. There is also a need for a mixer in which the height of the mixer may be adjusted appropriately to accommodate various loading and unloading devices without requiring time consuming adjustments to the mixer structure.

Further, there is a need for a mixer shaft drive system and control means wherein the velocity and relative rotational position of the mixer shafts to each other may be controlled in accordance with the particular material being mixed in addition to being readily stopped upon material jamming the blades.

Finally, there is a need for a mixer having the ability to accurately measure the quantity of different added materials, and being able to mix the different materials together at a velocity and duration sufficient to cause a predetermined chemical transformation.

SUMMARY OF THE INVENTION

The mixing apparatus of the present invention includes a mixing body or bin which is suspended from a mixer frame by means of cables. Opposing ends of the mixer body are formed with sheaves and the cables are wrapped around each of the sheaves with opposing ends of each cable extending upwardly to engage respective pulley systems mounted to the frame.

Each pulley system is provided with a cylinder for moving a respective end of a cable to thereby move the mixer body. Thus, by simultaneously actuating all of the cylinders to move their respective pulley systems, the mixer body may be elevated or lowered. Further, by actuating two of the cylinders at opposing ends of the mixer body to an extended position and by actuating the other two of the cylinders to a retracted position, the cables will be moved to cause the mixer body to tilt or rotate about its longitudinal axis to thereby empty the contents from the body.

The mixer further includes a plurality of mixer shafts and preferably includes two mixer shafts located in parallel relation to each other along the length of the mixer body. The mixer shafts are each provided with a plurality of mixer blades extending radially from the shafts for mixing material within the mixer body.

The shafts are positioned relative to each other and the blades are dimensioned such that the blades mounted to one of the shafts will pass in close proximity to the other shaft whereby the paths followed by the mixer blades overlap each other, as viewed from the ends of the shafts. Further, the shafts rotate in directions counter to each other whereby material in the center of the mixer body is scooped upwardly to pass between the two shafts.

In the preferred embodiment, the blades on each shaft are located at staggered positions along the longitudinal axis of the shaft and each successive bade is oriented at 90° relative to the immediately preceding blade. The angular position of the blades on one shaft may be altered relative to the angular position of the blades on the other shaft by varying the relative rotational position of the shafts to each other.

Each of the shafts is provided at one end with a hydraulic motor and at an opposite end with a speed and position sensor which is connected to a microprocessor for controlling the power to the hydraulic motor. Thus, the microprocessor may be programmed to position the shafts at a particular angular relationship relative to each other by control means associated with the hydraulic motors. In this manner, the relative positions of the blades on the two shafts may be adjusted to control the amount of shear imparted to the material being mixed by the movement of the blades as they pass each other.

The motor control system is also provided with pressure relief valves controlled by the microprocessor in response to a signal from the speed and position sensors indicating that the blades have become jammed or stopped. The pressure relief valves may also operate in response to a build up of pressure in the hydraulic circuits supplying hydraulic fluid to the motors. When the blades are in a jammed condition, the pressure relief valves located in each of the hydraulic drive lines to the hydraulic motors will open to bypass hydraulic fluid around the motors to thereby to relieve pressure on the blades.

The microprocessor may also be programmed to reverse the rotational direction of the shafts, upon sensing a jammed condition, in an attempt to dislodge any material which may be blocking the movement of the blades. In addition, the microprocessor may be programmed to allow the blades to drift from their predetermined relative angular positions as they rotate in order to accommodate any large objects or foreign bodies which may be contained in the material being mixed. Thus, the design of the system is such that it has a resiliency or flexibility to accommodate inhomogeneous matter without causing undue stress on the blades as they rotate.

The structure of the present mixer is specifically designed to provide the ability to accurately measure an amount of contaminated material placed in the mixer, the ability to agitate the contaminated material at a proper velocity and retention time in the mixer to generate a homogeneous product, the ability to accurately add a desired amount of a second material, and the ability to agitate the contaminated material with the second material at a velocity and duration sufficient to cause a desired chemical transformation prior to the addition of additional materials.

Other objects and advantages of the invention will be apparent from the following description, the accompanying drawings and the appended claims.

DETAILED DESCRIPTION OF THE PREFERRED EMBODIMENT

Figures 1, 2:
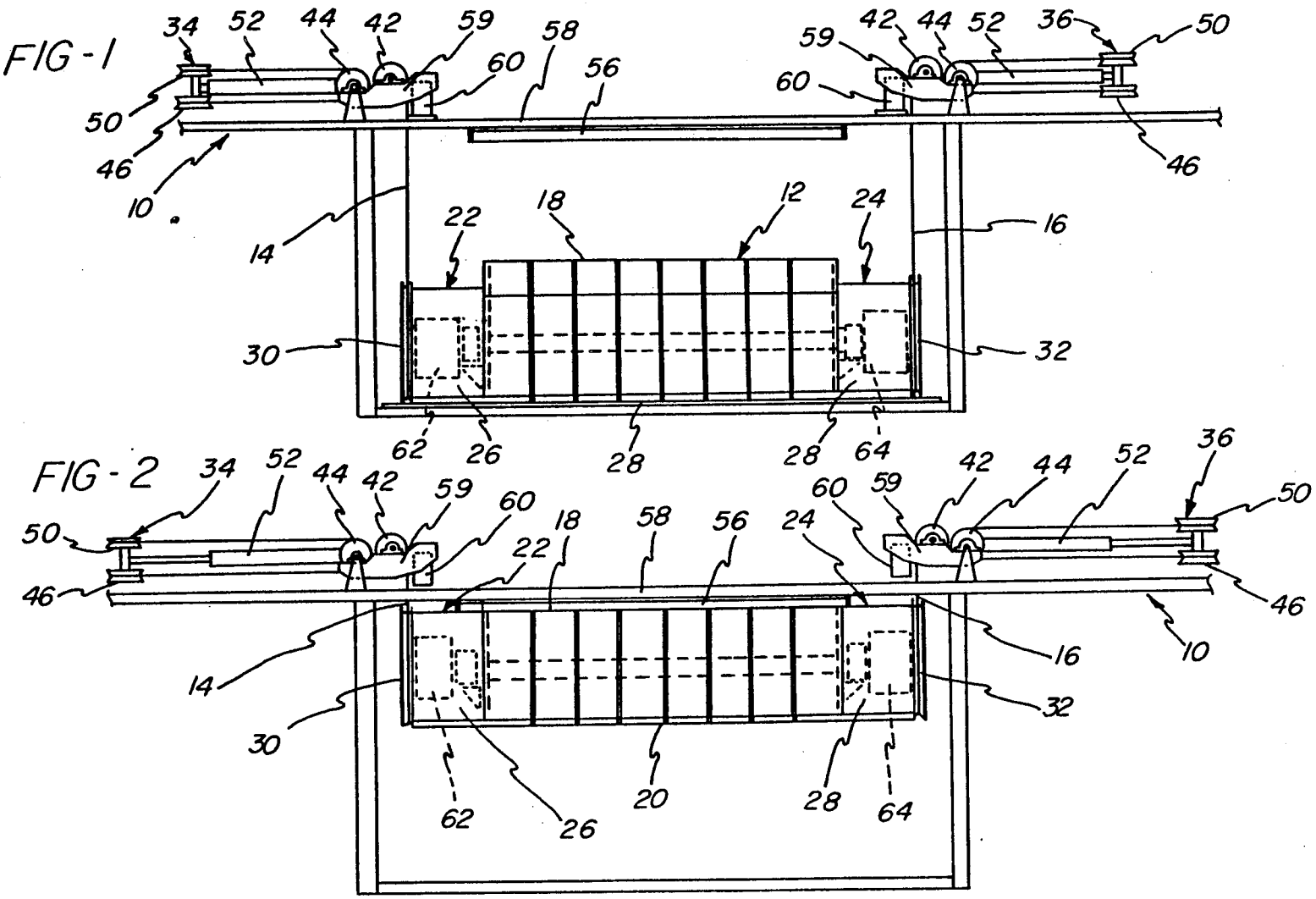
FIG. 1 is an elevational view of the mixer with the body portion in a lowered position.
FIG. 2 is an elevational view of the mixer with the body portion in an elevated position adjacent to the lid.

Referring to FIGS. 1 and 2, it can be seen that the present invention includes a mixer frame 10 for suspending a mixer body portion 12 by means of cables 14 and 16. The body portion 12 is defined by upper and lower sides 18, 20 and opposing ends 22, 24, and each end 22, 24 includes a housing portion 26, 28, respectively, for housing a pair of hydraulic motors and speed and position sensors, to be described below. In addition, each end 22, 24 is formed with a sheave 30, 32 at outer portions thereof for receiving a respective cable 14, 16. In the preferred embodiment, each of the cables 14, 16 extends around a respective sheave 30, 32 at least one and a half turns.

Figure 3:
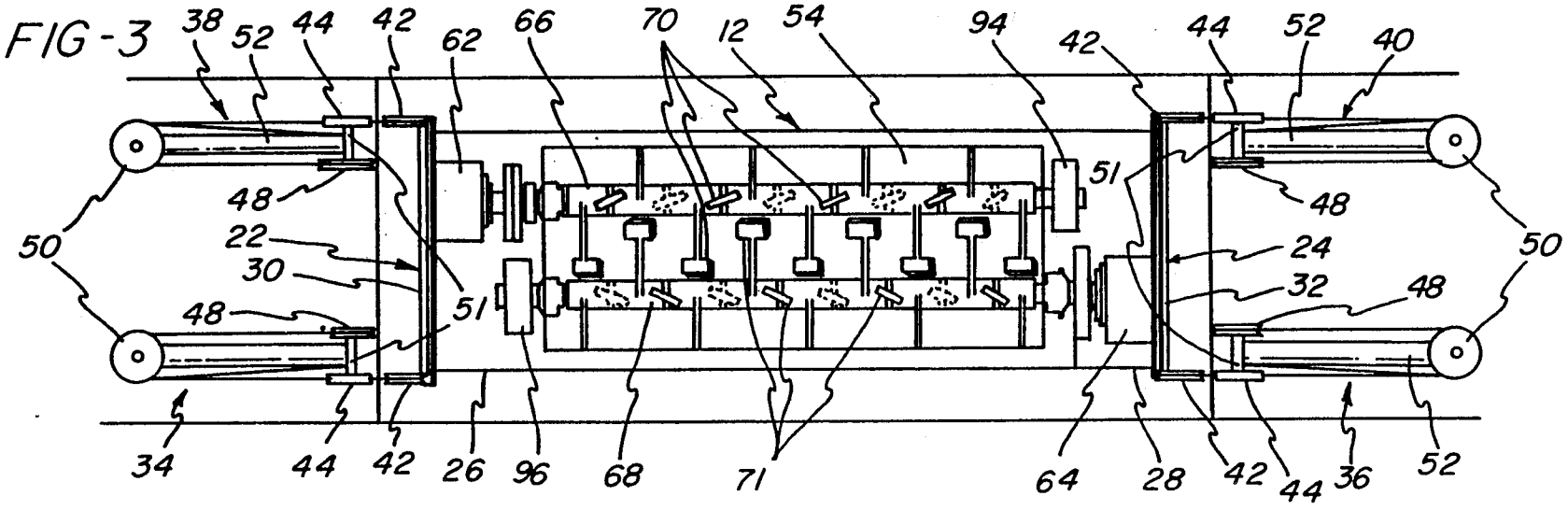
FIG. 3 is a plan view of the mixer without the lid structure.

Referring now to FIGS. 1 and 3, the pulley systems 34, 36, 38, 40 for actuating the cables 14, 16 to move the mixer body 12 will be described with specific reference to the pulley system 34 for manipulating one end of the cable 14. As may be seen in FIG. 1, the cable 14 first extends upwardly over a support pulley 42 and then downwardly under a vertically oriented outer pulley 44 which is aligned with the pulley 42. The cable 14 then extends around a horizontal lower pulley 46 and subsequently extends upwardly around a vertically oriented inner pulley 48 located adjacent to outer pulley 44, and finally around a horizontally oriented upper pulley 50 located adjacent to lower pulley 46. Finally, the cable 14 extends toward and is attached at a point 51 adjacent to the pulleys 44, 48.

It will be noted that the pulleys 44, 48 form a first pulley set spaced apart a distance approximately equal to the diameter of the pulleys 46, 50 forming a second pulley set. Also, the pulleys 46, 50 of the second pulley set are spaced apart a distance approximately equal to the diameter of the pulleys 44, 48 of the first pulley set such that the cable is properly aligned with each of the pulleys forming the first and second pulley sets.

The second pulley set 46, 50 is mounted for movement in a direction toward and away from the body portion 12 of the mixer, and a cylinder 52 is positioned extending between the first pulley set 44, 48 and the second pulley set 46, 50 to thereby move the second pulley set toward and away from the first pulley set 44, 48. It should be noted that each of the pulleys 44, 46, 48, 50 are freely rotatable with respect to each other. Thus, as the cylinder 52 is actuated to extend the second pulley set 46, 50 away from the first pulley set 44, 48, the pulleys act in the same manner as a block and tackle arrangement such that the movement of the second pulley set 46, 50 results in a proportional and greater movement of the portion of the cable 14 extending downwardly from the pulley 42 to the body portion 12.

With the particular arrangement shown, for every unit of movement of the second pulley set 46, 50 toward or away from the first pulley set 44, 48, the movement of the cable 14 between the pulley 42 and the body portion 12 will be multiplied by a factor of 4.

The operation of the pulley systems 34, 36, 38, 40 in conjunction with the cables 14 and 16 to perform lifting and tilting operations on the body portion will now be described with reference to FIGS. 1, 2, 4 and 5. The body portion 12 is shown in a lowered position in FIG. 1 such that material may be loaded through an aperture 54 defined in the upper side 18 of the body portion 12.

After material is loaded into the body portion 12, the cylinders 52 in each of the pulley systems are actuated simultaneously to extend the second pulley sets away from the first pulley sets to thereby pull the ends 22, 24 of the body portion 12 upwardly with respect to the frame 10. FIG. 2 illustrates the body portion 12 in its uppermost position and with the second pulley sets in their outermost extended position.

A lid 56 is mounted to the frame 10 in stationary relationship thereto by means of a beam 58 extending longitudinally between opposite ends of the frame 10. The lid 56 is sized to cover and seal the entire aperture 54 in order to prevent material from flying out of the body portion 12 as the material is being mixed. This is particularly useful in the case where the material being mixed comprises fine dust-like particles which may become suspended in the air and escape from the body portion 12 during the mixing operation.

Figure 5:
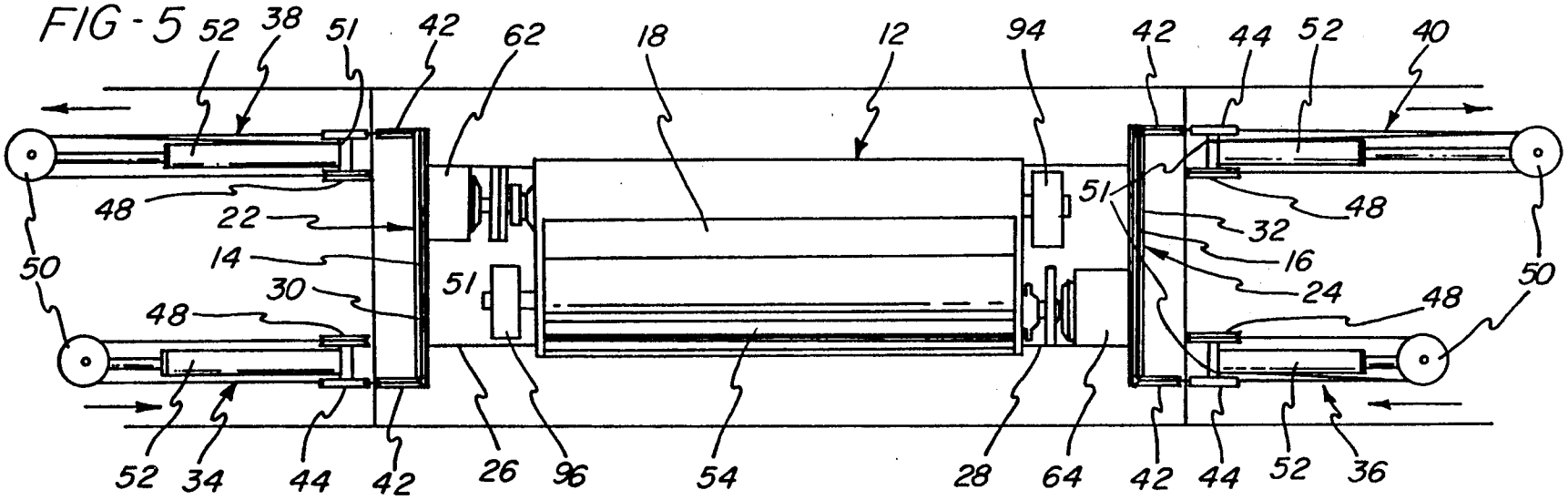
FIG. 5 is a plan view of the mixer without the lid structure in which the cable actuating pulley system is positioned to tilt the mixer body to the position shown in FIG. 4.
Figure 4:
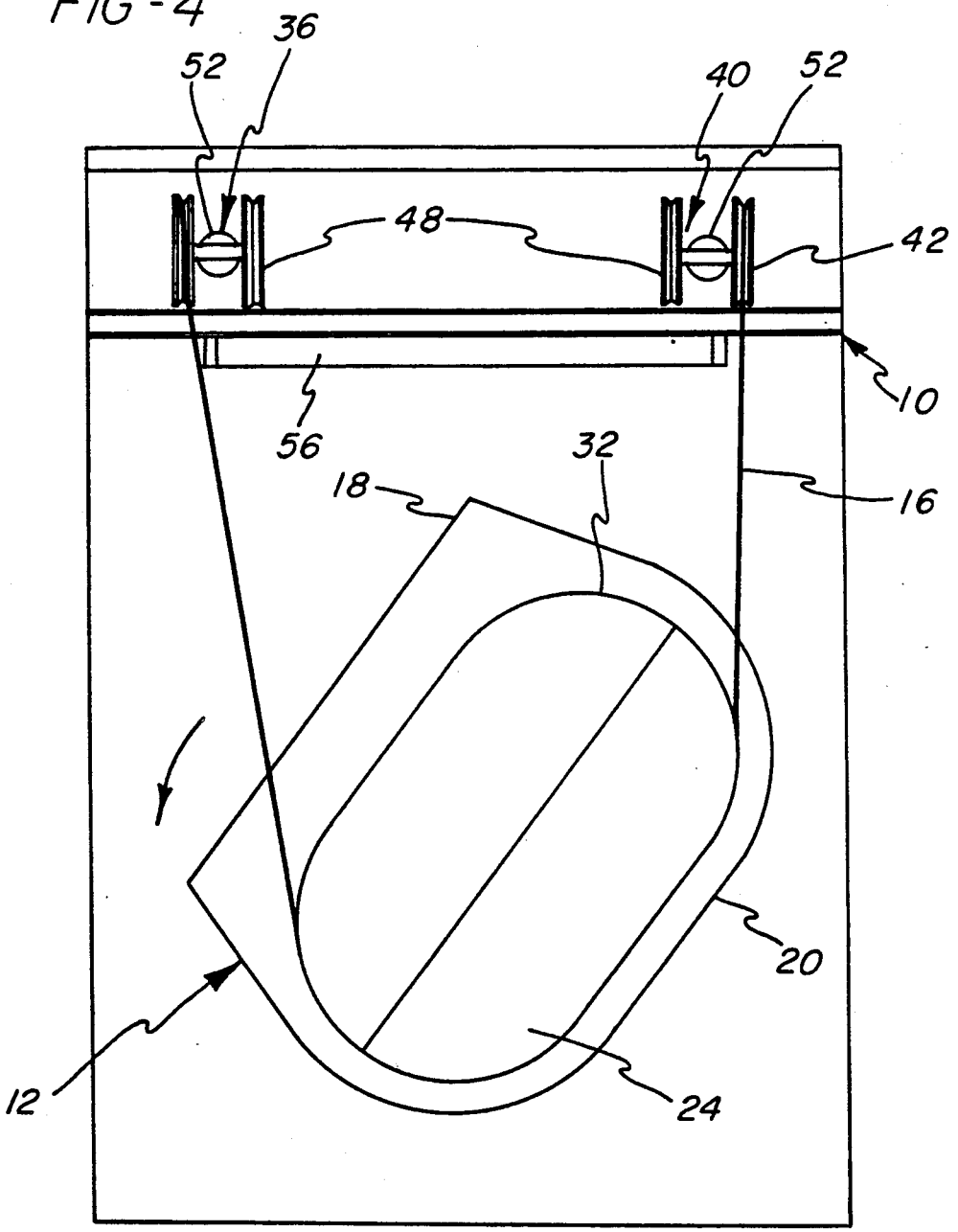
FIG. 4 is an elevational view from one end of the mixer with the mixer body partially tilted toward an inverted position for emptying the mixer body.

Referring now to FIGS. 4 and 5, the material within the mixer may be dumped out by first actuating the second sets of pulleys 46, 50 of each of the pulley assemblies 34, 36, 38, 40 to move slightly toward the first sets of pulleys 44, 48 whereby the body portion 12 is lowered to a position clear of the lid 56. Subsequently, one pair of opposing pulley assemblies, such as assemblies 34 and 36, may be actuated such that the cylinders 52 draw the second pulley sets 46, 50 of these assemblies in toward the first pulley sets 44, 48 to thereby extend one side of each of the cables 14 and 16 between the pulleys 42 and the body ends 22, 24. As the one side of each of the cables 14 and 16 are extended, the body portion 12 will tilt or roll about its longitudinal axis to perform an emptying operation. FIG. 4 illustrates the body portion 12 in an end view in which the body portion 12 is partially tilted as it moves toward a fully inverted position in which it is rotated 180° from its upright or loading and mixing positions.

It should be apparent that by combining the lifting and tilting mechanism into a single cable support system for the body portion 12, it is possible to provide a plurality of heights from which the body portion 12 may be emptied and thus it is possible to accommodate several different configurations of collection containers for transporting the mixed material away from the mixer. In addition, the present cable suspension system for the body portion 12 allows the aperture 54 to be used for both the loading and unloading operations and thus avoids the problems associated with prior art batch mixers which rely on seals in a lower portion of the mixer to prevent the material from escaping through a discharge opening during the mixing operation. Also, by providing means for fully tilting the body portion 12 to an inverted position, it is possible to ensure that the material within the mixer will be completely discharged.

It should further be apparent that by providing a mixer body portion 12 of sufficient size and capacity to receive material from a tractor/loader or excavating machine, the cable system of the present invention provides a convenient means for lowering the body portion 12 so that material from such a machine may be loaded directly through the aperture 54. Subsequently, the mixer body 12 may be lifted to an appropriate height or position for performing the mixing operation.

Referring again to FIGS. 1 and 2, it can be seen that the support pulleys 42 are each mounted to the frame 10 by means of a cantilevered arm 59. The arm 59 is pivoted at one end thereof about the rotational axis of the first set of pulleys 44, 48, and is supported at the opposite end by a load cell 60 attached to the frame 11. Since an end of each of the cables 14, 16 passes over the pulleys 42, the vertical force exerted on the load cell 60 supporting the pulleys 42 may be used to calculate the weight of the material added to the body 12. Thus, various constituents may be weighed as they are added to the body 12 to obtain accurate material proportions which are often required during the stabilization and neutralization of waste materials. The load cells 60 provide a convenient means for successively weighing each ingredient as it is added to the mixer body 12 and thereby provides a convenient means for directly weighing each ingredient at the mixing location.

As may be best seen in FIG. 3, the housing portions 26, 28 of the body portion 12 each enclose one of a pair of hydraulic motors 62, 64 for driving an associated pair of shafts 66, 68 which extend longitudinally through the body portion 12. The shafts 66, 68 each support a plurality of beater arms or mixer blades 70, 71, respectively. The blades 70 are staggered longitudinally along each shaft 66, 68 and each successive blade 70, 71 is preferably oriented at 90° around the shaft relative to a preceding blade. Further, the shafts 66, 68 are positioned such that the blades 70, 71 on one shaft will pass in close proximity to the adjacent shaft as the shafts 66, 68 are rotated by the motors 62, 64.

It should be noted that although the present embodiment is described with reference to the blades 70, 71 being displaced from adjacent blades 70, 71 by 90° on their respective shafts 66, 68, other configurations are possible. For example, it is possible to orient the blades such that each succeeding blade is located on a diametrically opposite side of the shaft from the immediately preceding blade on the same shaft whereby the blades on each shaft are oriented at 180° with respect to each other.

Figure 8:
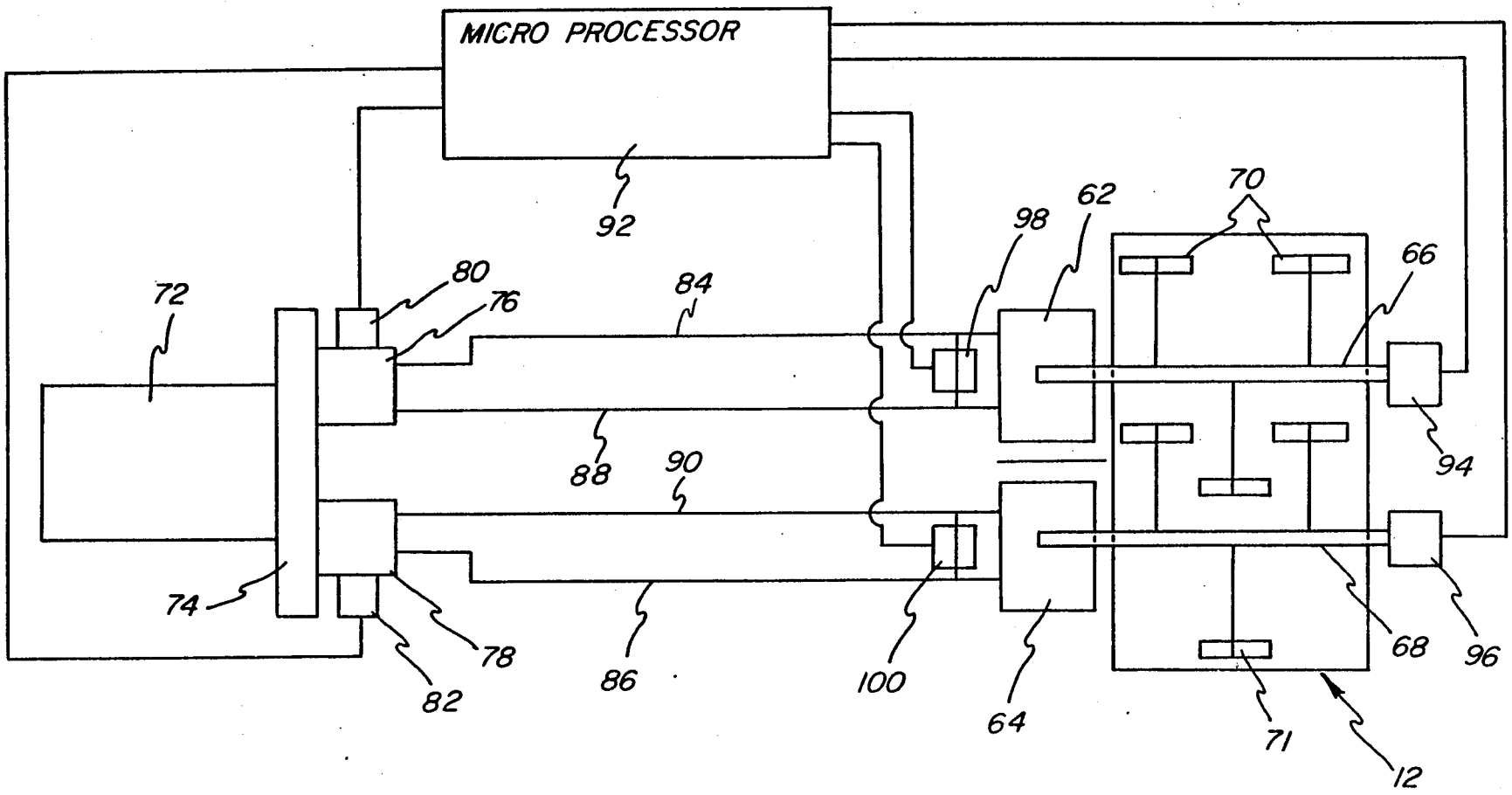

The mixing apparatus of the present invention further includes a microprocessor controlled hydraulic system for controlling power from the hydraulic pumps 76, 78, as illustrated diagrammatically in FIG. 8. The hydraulic system for supplying the power to the hydraulic motors 62, 64 includes a prime power source 72 which may be in the form of an internal combustion engine having a rotating output shaft. A power divider or transmission mechanism 74 is attached to the prime power source 72 and may include a geared mechanism to equally divide the power from the output shaft of the prime power source 72 to power two variable volume axial piston pumps 76, 78 which are commonly known as hydrostatic pumps. The variable volume hydraulic pump sold under the name HYDROMECAN and produced by Flender Corporation of Elgin, Illinois has been found to be satisfactory for the present application. Each of the hydraulic motors 62, 64 is provided with a hydraulic fluid supply line 84, 86 and return lines 88, 90 connecting the motors 62, 64 to a respective pump 76, 78.

Each pump 76, 78 is provided with an electric displacement control 80, 82 for controlling the volume displacement of the hydraulic fluid during pump operation. Such a displacement control typically varies the position of the swash plate within the pump in a manner well-known in the pumping art and a satisfactory displacement control is the MCV 104 electric displacement control produced by Sunstrand Corporation of Rockford, Illinois. The electric displacement controls 80, 82 operate in such a manner as to ensure that the volume of hydraulic fluid supplied to the lines 84, 86 remains constant regardless of variations in the speed of the prime power source 72. Further, the controls 80, 82 are connected to a microprocessor 92 in a manner such that the relative rotational positions of the shafts 66, 68 may be accurately controlled by appropriate control of the hydraulic fluid being supplied to the motors 62, 64.

The control system for controlling the relative rotational positions of the shafts 66, 68 via the pumps 76, 78 include speed and position sensors 94, 96 positioned in association with a respective shaft 66, 68 and connected to the microprocessor 92. The speed and position sensors 94, 96 are preferably in the form of absolute encoders which produce an output from which the microprocessor 92 may determine the precise angular position of each of the shafts 66, 68.

The microprocessor is provided with means whereby an operator may program the mixer control system to operate within certain preselected parameters during a mixing operation. For example, during a typical operation in which fine material is to be mixed, it is desirable to have the shafts 66, 68 rotating counter to each other with the mixing blades 70, 71 of each of the shafts 66, 68 oriented to operate in synchronism with each other. In other words, when a set of blades 70 on the shaft 66 pass through a plane defined by and extending between the shafts 66, 68, a set of blades 71 on the other shaft 68 simultaneously pass through the plane between the shafts 66, 68. Thus, the blades 70, 71 on the shafts 66, 68 pass each other in close proximity to one another such that a maximum shear effect is obtained which is desirable during mixing of fine particulate matter to ensure that the material is thoroughly mixed.

Figure 6:
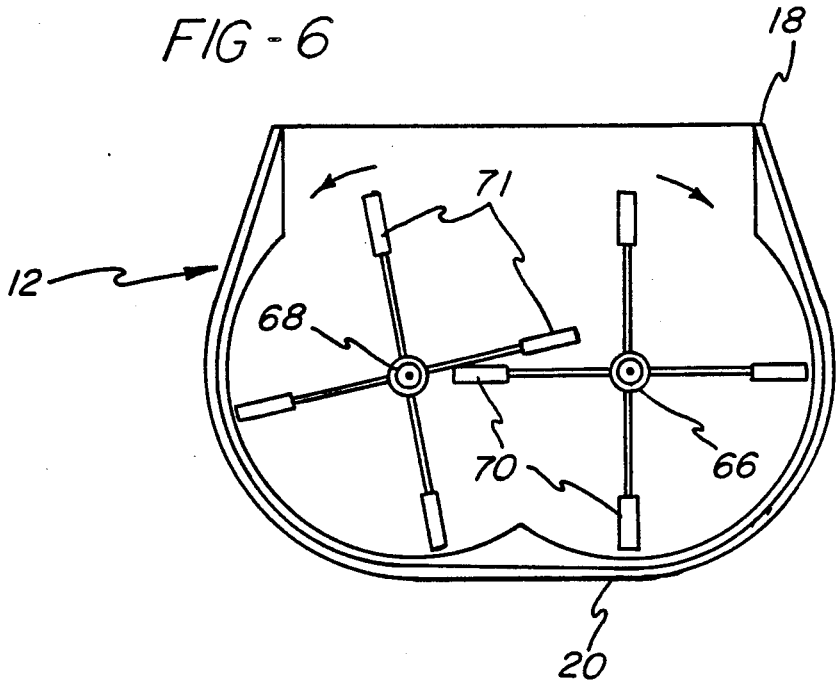
FIG. 6 is a diagrammatic end view of the shafts and mixer blades within the mixer body in which the blades of one shaft slightly lead the blades of the other shaft.

In an alternative mode of operation, as shown in FIG. 6, the microprocessor 92 may be programmed such that one of the shafts 68 is slightly rotated relative to the other shaft 66 such that its blades 71 are slightly rotationally displaced from the synchronous position and they lead the blades 70 as they pass through the plane defined by and extending between the shafts 66, 68. Such a relative rotational position of the shafts 66, 68 may be desirable for mixing materials which are slightly coarser than the fine materials described above with regard to the synchronous orientation of the shafts 66, 68.

Figure 7:
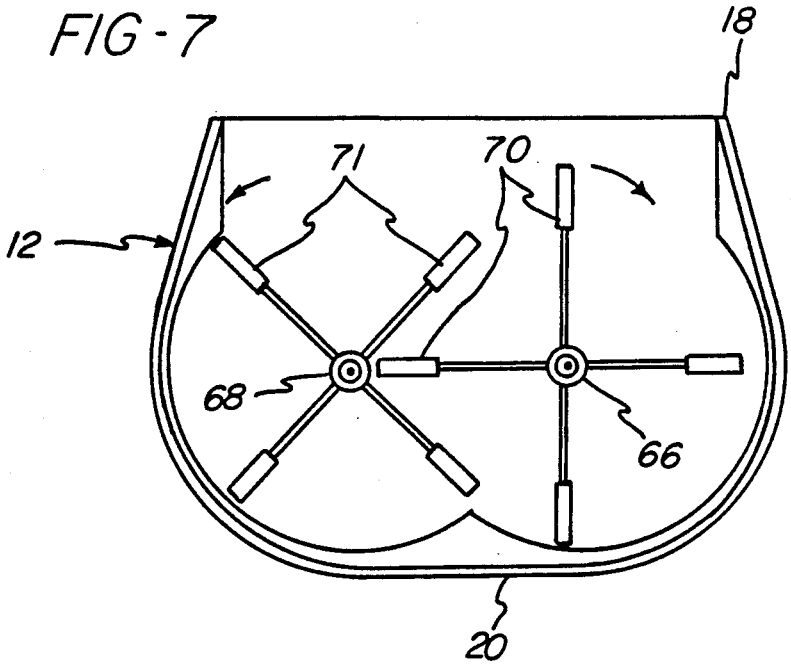
FIG. 7 is a view similar to FIG. 6 in which the blades on the two shafts are positioned relative to each other so as to produce a minimum amount of shear.

FIG. 7 illustrates a rotational position in which the blades are displaced from each other by approximately 45° to define a relative angular phase relationship between the blades 70, 71 prior to beginning rotation of the shafts 66, 68 to mix the material. This position is the mode in which a minimum amount of shear is produced. This mode of operation is useful when mixing materials which are very inhomogeneous and which include large bulk pieces and foreign material which could cause the blades to jam. For example, in many instances the material being mixed includes pieces of plastic or paperboard packaging forming the container used to transport the material. Thus, the spacing between the blades 70, 71 provides the necessary clearance to permit the shafts 66, 68 to continue to rotate in spite of interfering bulk substances.

It should be noted that in the preferred embodiment the counter-rotating twin shaft design, discussed above, is used due to the inherent self-cleaning effect which occurs when the periphery of the blades on each shaft travel in close proximity to the mixer body and the opposing shaft whereby the material is constantly scraped from the mixer body and the opposing shaft. In addition, it should be noted that the plane of each blade is oriented relative to the axis of a respective shaft at a sufficient angle to induce a lateral movement of material parallel to the mixer shaft as each blade moves through an arc in close proximity to the mixer body.

The blades on the shaft 66 are oriented such that they will cause the material to move in a lateral direction opposite to the direction in which the blades on the shaft 68 cause the material to move. Thus, the entire burden of material in the mixer is not only agitated but also circulates completely about the interior of the mixer body. The exception to the above-described orientation of the blades being that the blades located at the extreme ends of the mixer shafts are mounted at an angle to propel the material away from the end walls of the mixer body 12 when the shafts are being rotated in the forward direction.

By continually sensing the relative rotational positions of the shafts 66, 68, the microprocessor is able to control the displacement controls 80, 82 such that the proper amount of hydraulic fluid will be supplied through the lines 86, 88 thereby ensuring that the selected rotational positions are maintained. It should be noted, however, that in the event that the blades 70, 71 on one of the shafts 66, 68 encounters resistance, the microprocessor 92 will permit the shafts 66, 68 to displace from their preselected rotational orientation by an amount equal to the rotational displacement of adjacent blades on either of the shafts 66, 68, or 90° in the presently described embodiment, at which time the microprocessor 92 will cause the motors 62, 64 to stop. When the blades 70, 71 encounter resistance such that the shafts 66, 68 are displaced from their preferred rotational orientation, the microprocessor 92 will alter the fluid flow to the motors 62, 64 to bring the shafts 66, 68 back into their preferred orientations.

If the blades 70, 71 on one or both of the shafts 66, 68 encounter an obstacle which prevents rotational movement of the shafts 66, 68, a hydraulic bypass circuit in each of the hydraulic fluid supply and return lines will be activated to bypass the hydraulic fluid away from the motors 62, 64. The bypass circuit includes a pair of cross-tie valves 98, 100 which are connected across respective supply and return hydraulic lines 84, 86 and 88, 90. The cross-tie valves 98, 100 may be in the form of pressure relief valves such as sold by Rexroth Corporation of Bethlehem, Pennsylvania, The valves 98, 100 are positioned such that they will bypass the flow of hydraulic fluid from the supply lines 84, 86 directly to the return lines to bypass the motors 62, 64 in either the event that a pressure build-up occurs within the hydraulic lines, or the sensors 94, 96 sense that one or both of the shafts 66, 68 is stopped. When it is sensed that one or both of the shafts 66, 68 is stopped, the microprocessor 92 causes a solenoid on the appropriate valve 98, 100 to be actuated causing a very rapid opening of the respective valve.

In the event that a foreign object jams the blades 70, 71 the displacement controls 80, 82 may be actuated to reverse the flow in the hydraulic lines 84, 86, 88, 90 to thereby reverse the rotational direction of the shafts 66, 68. After the foreign object has been dislodged, the flow in the hydraulic lines will again be reversed such that the shafts 66, 68 resume their normal rotational direction. In addition, the microprocessor 92 may be programmed such that when a jam-up is sensed, the motors 62, 64 will be automatically jogged forward and backward a predetermined number of times in an attempt to dislodge the foreign object.

Alternatively, the operator may be provided with appropriate switches for actuating the displacement controllers 80, 82 to jog the motors 62,.64 backward and forward. If the jogging operation does not result in the foreign object becoming dislodged, the operator may be required to dump the load of material within the body portion 12 and proceed with mixing a different load of material.

It should be noted that the displacement controls 80, 82 are capable of adjusting the flow of fluid through the hydraulic lines to the motors 62, 64 such that the motors may be operated at a variety of speeds, so long as the motors 62, 64 are both operated at the same speed in order to maintain the preselected relative rotational positions of the two shafts 66, 68. In the preferred embodiment, the pressure produced by the pumps 76, 78 is adjusted to be only high enough to cause the hydraulic motors 62, 64 to operate under a normal load condition. Any unusual stress caused by foreign objects or oversized particles that could lodge in or block the free travel of the blades 70, 71 would be sensed by an increase of pressure resistance to the pump control resulting in the flow of fluid from the pumps 76, 78 being stopped.

Further, by providing hydraulic motors 62, 64 for driving the shafts 66, 68, the assembly supported by the cables 14, 16 is lightweight compared to conventional electric drive motors. Also, the hydraulic motors 62, 64 of the present invention provide flexibility in the operation of the mixing apparatus in that when a jam-up occurs, the shafts 66, 68 may deviate from their predetermined rotational orientation and thereby avoid the danger of damaging a geared transmission such as commonly occurs with conventional mixing devices.

Another advantage of eliminating mechanical gearing between the two shafts 66, 68 is that the relative rotational position between the shafts may be quickly changed during or between operation of the mixer and thus the present mixing apparatus may accommodate a wide variety of mixing requirements without mechanical changes to the device.

It should be apparent that the present cable support system for the mixing bin provides a compact actuating means for manipulating the bin. Thus, the present mixing apparatus may be readily adapted for mounting on a vehicle such as a truck bed or trailer, whereby the apparatus may be made portable.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims.

What is claimed is:

1. A mixing apparatus comprising:

a mixer frame;

a body portion having upper and lower sides and opposing ends;

means defining an aperture in said upper side of said body portion for receiving materials to be mixed;

a mixing shaft extending through said body portion between said opposing ends and including mixing means for contacting and moving material within said body portion upon rotation of said mixing shaft; and lifting and tilting means mounting said body portion to said frame for performing a lifting operation wherein said body portion is lifted relative to said frame, and for performing a tilting operation wherein said body portion is tilted to a substantially fully inverted position such that any material being mixed within said body portion will be emptied therefrom through said aperture.

2. The apparatus of claim 1 wherein said lifting and tilting means is adapted to perform said lifting operation as a separate operation from said tilting operation.

3. The apparatus of claim 1 including a lid portion supported by said frame above said body portion, said lid portion covering said aperture to close off said body portion when said tilting and lifting means lifts said body portion to an uppermost position, and said lid portion being spaced from said aperture when said body portion is in a lowered position below said uppermost position.

4. The apparatus of claim 1 wherein said tilting and lifting means includes a system of cables for supporting said body portion from said frame.

5. The apparatus of claim 4 wherein each of said ends of said body portion includes a sheave and said system of cables comprises a cable extending around each of said sheaves, said lifting and tilting means further including four cylinders supported by said frame wherein a set of two cylinders operates on opposing ends of each of said cables to effect said lifting and tilting operations.

6. The apparatus of claim 5 including pulleys supported by load cells mounted to said frame, said cables passing over said pulleys such that the weight of material contained within said body portion may be determined from outputs produced by said load cells.

7. The apparatus of claim 1 wherein a pair of mixing shafts are provided positioned in parallel relationship to each other between said opposing ends and a pair of hydraulic motors are provided, each of said hydraulic motors being positioned at an end of one of said shafts and being connected to separate hydraulic drive circuits, sensing means for sensing the angular position and rotational speed of said mixing shafts, and control means for receiving inputs from said sensing means and controlling said hydraulic drive circuits for said motors.

8. The apparatus of claim 7 wherein said control means is programmable such that a predetermined angular relationship may be maintained between said mixing shafts during operation of said mixer.

9. The apparatus of claim 8 wherein said mixing shafts may drift from said predetermined angular relationship by a predetermined amount in response to material in said mixer exerting resistance to rotation of said mixing shafts.

10. The apparatus of claim 9 wherein upon receiving inputs from said sensor means indicating that said mixing shafts have drifted from said predetermined angular relationship by said predetermined amount, said control means will stop said mixing shafts.

11. The apparatus of claim 1 wherein said body portion rotates at least approximately 180° about a central longitudinal axis of said body portion.

12. A mixing apparatus comprising:

a mixer frame;

a body portion having upper and lower sides and opposing ends, said body portion being supported by said mixer frame;

means defining an aperture in said body portion for receiving materials to be mixed;

first and second mixing shafts, each shaft including a plurality of blades for moving said materials in said body portion;

first and second hydraulic motors connected to said first and second mixing shafts, respectively;

first and second hydraulic circuits for providing hydraulic fluid to drive said first and second motors independently of each other; and wherein the path followed by the blades of said first and second mixing shafts overlap each other such that said blades on said first shaft pass in close proximity to said second shaft and said blades on said second shaft pass in close proximity to said first shaft.

13. The apparatus of claim 12 including first and second variable volume pumps in said first and second hydraulic circuits, respectively, for supplying said hydraulic fluid to said motors, and first and second bypass means for bypassing fluid past said motors.

14. The apparatus of claim 13 including sensing and control means for sensing the rotational speed of said shafts and for actuating said bypass means upon sensing stoppage of said shafts.

15. The apparatus of claim 13 wherein said first and second shafts are driven at the same rotational speed as each other and in opposite rotational directions.

16. The apparatus of claim 12 wherein said body portion is suspended from said mixer frame by means of cables engaging said ends of said body portion and means are provided for moving end portions of said cables whereby the vertical position of said body portion may be varied and said body portion may be tilted approximately 180° to empty said material form said body portion through said aperture.

17. A mixing apparatus comprising:

a mixer frame;

a body portion having upper and lower sides and opposing ends, said body portion being supported by said mixer frame;

means defining an aperture in said body portion for receiving materials to be mixed;

first and second mixing shafts, each shaft including a plurality of blades for moving said materials in said body portion;

first and second hydraulic moors connected to said first and second mixing shafts, respectively;

first and second hydraulic circuits of providing hydraulic fluid to drive said first and second motors independently of each other;

sensing means for sensing the relative angular orientation and rotational speed of said first and second shafts; and control means for receiving inputs from said sensing means and maintaining a desired angular relationship between the rotational positions of said first and second shafts.

18. The apparatus of claim 17 wherein said control means includes means for independently varying the volume flow rate of hydraulic fluid in said first and second hydraulic circuits.

19. In mixing apparatus for processing industrial wastes and the like in which a mixing container has a pair of mixing shafts, and beater arms extending from said shafts, the improvement comprising a separate hydraulic drive motor connected to rotate each of said shafts from a source of hydraulic fluid under pressure, control means for said motors including control means for said motors including sensing means for sensing the angular position of each of said shafts wherein said control means controls the fluid pressure to each of said motors in response to the sensed angular position of said shafts to control the relative angular phase relationship between the respective beater arms of said shafts.

20. The mixer of claim 19 further comprising means responsive to a sudden increase in hydraulic pressure to said motors indicating a jammed condition of at least one of said shafts for releasing the hydraulic pressure from said source to said motors.

21. A method for mixing material comprising:

providing a mixer body for receiving material to be mixed, providing first and second mixer shafts extending through said mixer body, said shafts each including blade portions extending radially from the longitudinal axes of said shafts, rotating said shafts in opposite directions nd at the same predetermined rotational velocity to thereby maintain a predetermined rotational relationship between said shafts, and providing sensing and control means for sensing the rotational positions of each of said shafts and for monitoring the relative angular phase relationship between the respective blades of said shafts to maintain a predetermined rotational relationship between said shafts.

22. The method of claim 21 wherein each of said shafts is driven by a hydraulic motor and prior to said step of rotating, at least one of said shafts is rotated to position said shafts in said predetermined rotational relationship.

23. The method of claim 22 wherein said sensing and control means cause said hydraulic motors to correct for any variations of the rotational relationship of said shafts from said predetermined rotational relationship by advancing at least one of said shafts toward said predetermined rotational relationship.

24. The method of claim 21 including providing sensing means for sensing stoppage of at least one of said shafts during said rotating step and upon sensing said stoppage, reversing the direction of rotation of said shafts.

25. The apparatus of claim 21 wherein said blades on said shafts each traverse a path which intersects a path traversed by blades on the adjoining shaft such that said blades of one of said shafts pass in between said blades on the other of said shafts.

* * * * *